United States Patent [19]

Flynn

[11] 4,155,586

[45] May 22, 1979

[54] TAILGATE LOCKING SYSTEM

[75] Inventor: Thomas P. Flynn, Milwaukee, Wis.

[73] Assignee: Super Products Corporation, Milwaukee, Wis.

[21] Appl. No.: 714,318

[22] Filed: Aug. 16, 1976

[51] Int. Cl.[2] ..... E05C 19/00

[52] U.S. Cl. ..... 296/56; 292/201; 292/304; 292/DIG. 71

[58] Field of Search ..... 296/50, 56; 292/201, 292/304, DIG. 71

[56] References Cited

U.S. PATENT DOCUMENTS

| | | | |
|---|---|---|---|
| 3,080,187 | 3/1963 | Lamb | 296/50 |
| 3,272,552 | 9/1966 | Park | 296/56 |
| 3,548,540 | 12/1970 | Cullings | 296/50 |
| 3,990,739 | 11/1976 | Head | 296/56 |

*Primary Examiner*—Richard A. Bertsch

[57] ABSTRACT

A system is disclosed for positively sealing the tailgate of a liquid or solid refuse collection body. The invention has special utility for vacuum containers in which a compressible seal surrounds the perimeter of the tailgate. The tailgate includes hooks having cam surfaces and the container includes rollers adapted for engaging the hooks and drawing the tailgate into positive engagement with the opening of the body. Hydraulic means are preferably provided for activating the rollers. If separate hydraulic means are employed for raising and lowering the tailgate, sequencing controls may be provided to permit locking the tailgate only after the tailgate hooks have been lowered to a position adjacent to the rollers.

17 Claims, 4 Drawing Figures

FIG.3
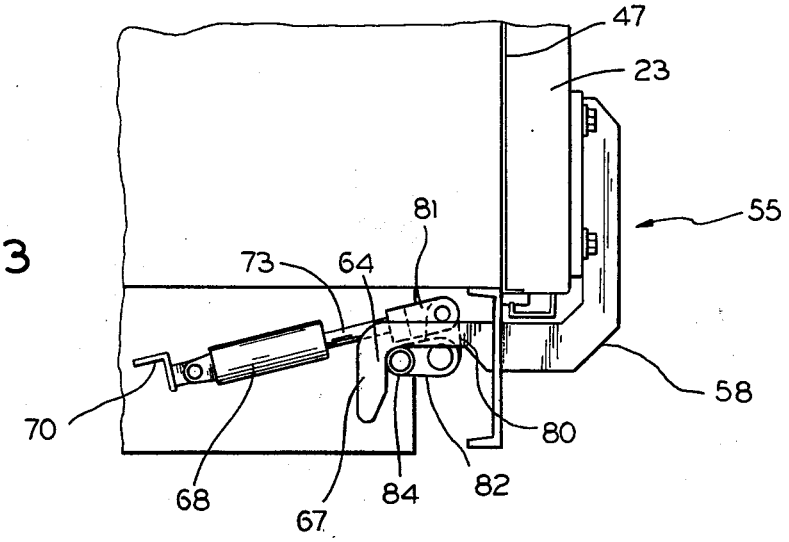
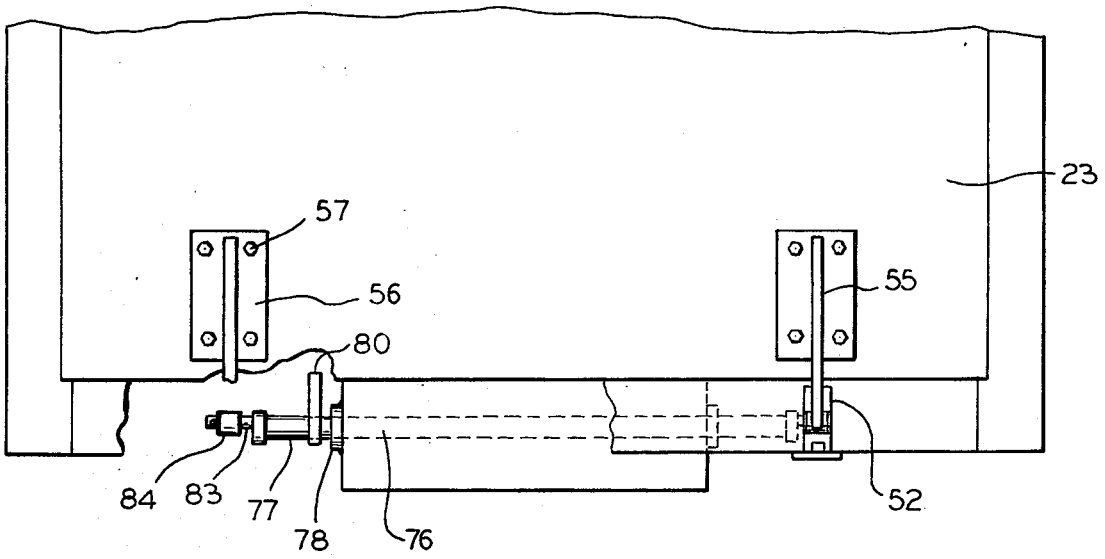
FIG.4

TAILGATE LOCKING SYSTEM

BACKGROUND OF THE INVENTION

This invention relates generally to the art of refuse containers and more specifically to the art of tailgate securing means for such containers.

A wide variety of refuse containers are known to the art including dump trucks, garbage trucks, sewer and catch basin cleaners, and industrial vaccuum loaders and cleaner. A common feature of such machines is a tailgate which is manually opened or opened by power means to permit discharge of the contents of the container body. Depending on the application, the material which will be contained in the body could be solid, liquid or a mixture.

It is essential that the tailgate be adequately sealed to the opening of the material collection body, e.g. to prevent spilling materials during truck movement. Tight sealing of the tailgate may not be necessary for some uses, but where liquids are to be held in the body or where the collection chamber is a vacuum chamber, tight sealing is required. In many cases, a compressible gasket is employed to insure such a seal.

There are literally dozens of other types of equipment where positive closure of an opening is required. For example, stationary vacuum loaders may have a collection body with a hinged cover to allow access to the body interior.

Several means are known to the art for aiding positive engagement between a tailgate and a truck body opening. For example, Pack in U.S. Pat. No. 3,272,552, describes the use of hooks on a truck body which engage a rim around the tailgate and a system for interlocking the tailgate lifting system with the closure hooks. Other known systems include the use of simple hook fasteners and manually operated cranks for drawing a tailgate into positive engagement with a truck body opening.

All of these systems suffer from one or more drawbacks, especially if they are employed on trucks which are designed to carry liquids or on trucks having a pusher plate or dump system for unloading the body. Often the material discharged from the body will foul the closure mechanism and interfere with proper sealing. Moreover, many prior art devices do not compensate for correct gasket compression and minor shifts in door alignment. A system for positively locking a tailgate or closure to a container opening which overcomes the aforementioned disadvantages would be a significant advance in this technology.

OBJECTS OF THE INVENTION

It is a primary objective of the present invention to provide a latching system for container tailgates which overcomes the aforementioned disadvantages.

It is another object of the present invention to provide a tailgate latching system in which latch hooks and other operative components are disposed in such a manner that material being ejected from a container does not interfere with latch operation.

Another object of the present invention is to provide a tailgate latching system that hydraulically and mechanically seals a tailgate to a container opening.

A still further object of the present invention is to provide a tailgate latching system which is virtually self-cleaning.

Yet another object of the present invention is to provide a tailgate latching system for correctly sealing a tailgate or door to an opening and in which adjustments can be made from time to time to provide proper compression of a sealing gasket.

How these and other objects of the present invention are accomplished will be described in the following specification taken in conjunction with the drawings. Generally, however, the present invention comprises a tailgate having at least one latching hook. A container body includes a shaft rotatable by approximately 90°. The shaft is fitted with a crank type link and off-center stub shafts with rollers for each hook.

When the tailgate is lowered to its closed but unlocked position, such as by a hydraulic double action cylinder, or by hand or by gravity, the shaft is rotated causing the rollers to engage a tapered portion of the hooks and follow a cam-like surface of the hooks causing the tailgate to seal against the container body. When the latch is closed, the cranks are positioned to lock the tailgate with a toggle mechanical action. To open the tailgate, the shaft is rotated in the opposite direction to drop the rollers which permits the hooks to travel on the arc of the tailgate hinge point.

In a preferred form of the present invention, a hydraulic sequencing control valve is added to the system to insure that the tailgate lowering function is completed before the latching function is initiated. Alternately, the latching operation may be controlled by manual control valves, electric or pneumatic systems, or other alternatives may be employed as described below.

DESCRIPTION OF THE DRAWINGS

FIG. 3 is another side view, similar to FIG. 2, but with the tailgate in the locked and sealed position; and FIG. 4 is an end view of the machine shown in FIG. 1, with parts removed, showing further details of the tailgate latching mechanism of the preferred form of the present invention.

DESCRIPTION OF THE PREFERRED EMBODIMENT

Figure 1:
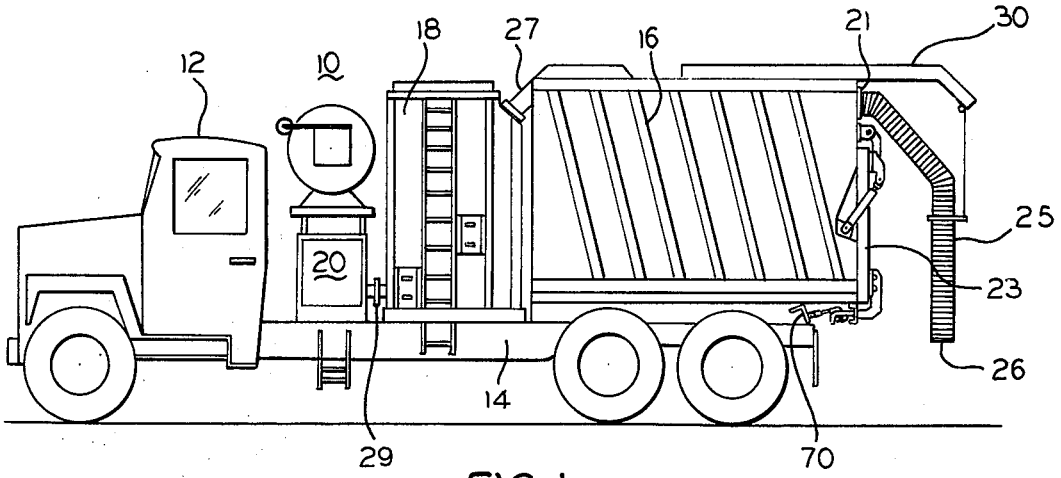
FIG. 1 is a side view of an industrial vacuum loader or cleaner showing in basic form one type of machine with which the tailgate locking system of the present invention may be used.

FIG. 1 shows a truck mounted industrial vacuum cleaner and loader 10 which has been chosen for purposes of illustrating the preferred embodiment of the present invention. It should be emphasized at the outset that the invention has many utilities besides the one illustrated. For example, the present invention can be employed on stationary or mobile systems and on container bodies which are tilted to remove material or containers which includes a pusher plate for pushing out collected material. The system can also be employed for closed containers (such as the one illustrated) or for open containers (such as a dump truck) and for systems designed for containing either solids or liquids. Finally, while the system will be described in connection with a hydraulic cylinder system for raising and lowering the tailgate, the latching system now to be described can be used with other types of power door positioning systems or for containers where the tailgate or door is raised and lowered manually. For these reasons most of the features of the mobile cleaner 10 will be described in a summary fashion as such features do not, in and of themselves, form a part of the present invention. If more detailed information regarding cleaner 10 or other mobile industrial vacuum loaders is desired, reference may be had to U.S. Pat. No. 3,885,932 issued May 27, 1975 to Lionel G. Moore, et al., entitled "Dust Filtration System."

Cleaner 10 includes a cab 12 and a chassis 14 for supporting three main cleaner components; a collection receptacle 16, a filter 18 and a pump 20. Receptacle 16 includes at least one inlet opening 21 and a tailgate 23 which may be opened manually, but in this case is opened by power means for allowing removal of the material collected into the body. Coupled to inlet 21 is a collection hose 25. The receptacle 16 and filter 18 are connected by a duct 27 and the filter 18 and pump 20 are connected by another duct 29.

In operation, cleaner 10 is driven to the work location. The pump 20 is activated to create a high velocity air stream suction flow through hose 25. The machine operator positions the free end 26 of hose 25 above the material to be collected and the material, which may be either solid or liquid, is sucked through hose 25 and deposited in receptacle 16. The air stream flows from receptacle 16 to the filter 18 through duct 27. The filter removes any fine particulate material entrained in the air stream. The air stream leaves the filter 18 and passes to pump 20 through duct 29 and is subsequently discharged to the atmosphere. The hose is supported from a horizontally rotatable and vertically elevatable boom 30.

Upon completion of the loading or cleaning operation the truck is driven to the desired unloading location where tailgate 23 is opened. Material is discharged by tilting receptacle 16 (by means not shown) or a pusher plate within receptacle 16 may be activated to push the material through the opening created by lifting tailgate 23.

Figure 2:
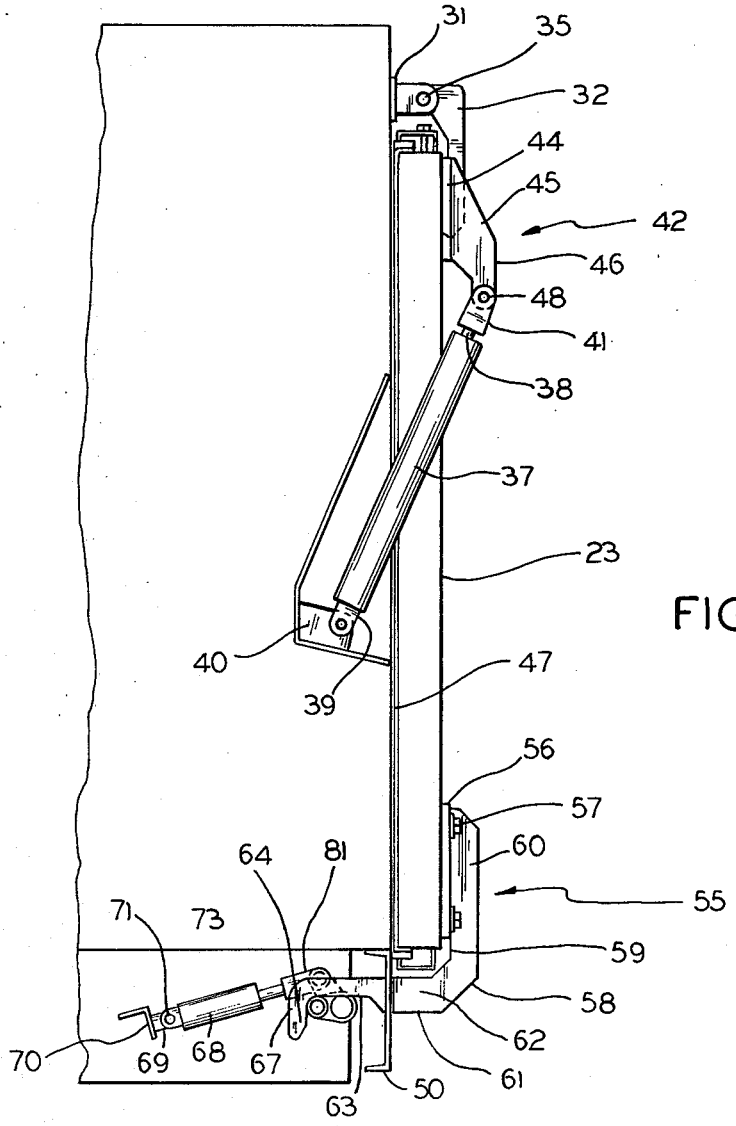
FIG. 2 is a side view of the tailgate portion of the machine shown in FIG. 1 illustrating details of the preferred latching system of the present invention, with the tailgate in the closed but unlocked position.

Turning now to the details of the present invention, FIG. 2 shows one preferred form. In this figure tailgate 23 is shown to be coupled to the rear of receptacle 16 by a hinge system including two spaced apart mounting brackets 31 secured to receptacle 16 and two additional spaced apart mounting brackets 32 attached to the upper edge of tailgate 23. The two sets of brackets are pivotally joined by a pair of co-axial bearing pins 35 to complete the tailgate mounting on receptacle 16.

The tailgate lifting mechanism of the preferred embodiment is also shown in FIG. 2 to include a pair of hydraulic lifting and lowering cylinders 37. Cylinders 37 each include an extensible piston 38 and a hydraulic fluid control means (not shown) for controlling the extension or retraction of pistons 38. The closed end 39 of the cylinders 37 are pivotally mounted to a pair of bracket anchors 40 on the rear of the sides of receptacle 16 at a height approximately equal to the mid-point of tailgate 23, while the free end of the piston are pivotally secured by clevis means 40 to a pair of bracket anchors 42 secured just below the top edge of tailgate 23. Brackets 42 include a mounting plate 44 which is bolted to the tailgate 23 and a perpendicular attachment ear 45 which includes a downwardly extending protrusion 46 which receives the coupling pin 48 joining the piston 38 thereto. The attachment ear 45 is offset to the outside of the upper corners of tailgate 23.

It should be mentioned here that other power means can be employed for raising and lowering tailgate 23. For example, a single hydraulic cylinder mounted between the top of the rear end of receptacle 16 and the bottom of tailgate 23 can be employed. Alternately, a cable and winch system can be used. Accordingly, the twin-cylinder arrangement of these drawings is to be taken as illustrative rather than limiting.

Also not shown in the drawings, but included within the scope of the present invention is a hydraulic fluid sensing system which determines when the tailgate lowering function has been completed, i.e., when the extensible pistons are in the fully lowered or retracted positions.

As mentioned previously, the illustrated machine is a vacuum machine for collecting solid or liquid materials. Therefore a tight seal is required between receptacle 16 and tailgate 23. To this end a resilient compressible gasket 47 is provided around the periphery of tailgate 23. The gasket 47 is compressed against the surface of the tailgate opening on the back of the receptacle 16 when tailgate 23 is in the fully lowered and locked position. The lower edge of the tailgate 23 is disposed just above a channel beam 50 extending across the rear of the body frame. Beam 50, as will be more fully understood below, includes a pair of spaced apart slot openings 52 and seal gasket 47 is designed to seat between the bottom edge of the tailgate and the rearward facing and upper surface of beam 50.

Locking of tailgate 23 is made possible by fastening hooks 55, two of which are disposed on the lower edge of tailgate 23. The hooks 55 are spaced apart by the same distance as channels slots 52 and are positioned directly above them.

Hooks 55 each include a mounting plate 56 which is secured by bolts 57 to tailgate 23. Shims (not shown) may be provided between plates 56 and the tailgate 23 to provide proper hook alignment. The hooks 55 also include a generally L-shaped, relatively thin plate 58, one inside edge 59 of one leg 60 being welded to plate 56. The outside edge 61 of the other leg 62 includes a cut-out portion 63 which creates a cam-like surface 64 on a downwardly extending protrusions 67 at the free end of leg 62.

The size and orientation of hook plates 58 are such that when the tailgate 23 is in a fully closed position, leg 62 passes through slots 52 of beam 50 toward the front of the machine 10. Leg 61 should be long enough so that the protrusion 67 and its cam surface 64 completely penetrate beam 50.

The remaining operative components of the latching system comprise a cylinder operated roller system for engaging the hook plates 58 and creating the positive lock for tailgate 23. The system includes a hydraulic cylinder 68 mounted beneath receptacle 16 having a first end 69 pivotally mounted to a bracket anchor 70, such as by pin 71. Cylinder 68 also includes an extendable piston 73 and hydraulic power control means for causing extension of piston 73 in a direction generally and toward and perpendicularly to beam 50.

Mounted adjacent and generally parallel to beam 50 is a bearing block 76 supporting a crank shaft 77. Crank shaft 77 is secured in bearing block 76 against axial movement by a pair of set collars 78. Shaft 77 extends between slots 52 and its ends are located adjacent to but interior of the inside edges of slots 52.

Crank shaft 77 also includes a latch cylinder lever 80 having one end fixedly secured to the shaft 77 and having its other end pivotally joined by clevis 81 to the free end of piston 73 of the latch cylinder 68. The components are so arranged that full extension of the piston from the position shown in FIG. 2 to the extended position shown in FIG. 3 will cause the crank shaft 77 to be rotated by approximately 90°. The direction of rotation is clockwise when viewing along the axis of the crank shaft as shown in FIGS. 2 and 3.

Each end of crank shaft 77 is fitted with a crank type link 82 and off center stub shafts 83 having rollers 84 secured thereover. FIGS. 2–4 show the positions of rollers 84 and the link 82 when the latch cylinder is in both the open and locked position.

The selection of the various components and the sizes and the spatial arrangement of the rollers 84 can probably best be understood by simultaneous reference to the drawings and to the following description of the operation of the preferred embodiment.

When the tailgate 23 is in the closed but unlocked position (FIG. 2) the rollers 84 are directed downwardly below the cut-out area 62 formed in leg 63 of hook plates 58. Extension of piston 73 causes the crank shaft 77 to rotate in bearing block 76 due to the forces exerted on latch cylinder lever 80. The rollers then rotate upwardly and engage the tip of protrusion 67 and then follow the cam shaped surface 64 thereon to the fully locked position shown in FIG. 3. As mentioned previously, the hooks 55 of the tailgate 23 may be appropriately shimmed from time to time to compensate for minor fluctuation in closure tolerances and gasket wear.

To unlock the tailgate 23 of cleaner 10, the piston 73 of cylinder 68 is retracted to the position shown in FIG. 1. This causes a counterclockwise rotation of crank lever 77 and a dropping of rollers 84 to the position shown in FIG. 2. This allows the tailgate 23 with its accompanying hooks 55 to be opened by the hydraulic cylinders 37.

As previously indicated, the tailgate latching system of the present invention is virtually self-cleaning. When the tailgate is opened to dump material from receptacle 16, the operative components of the latching system are disposed below the body in such a manner that debris does not interfere therewith or clog the hook or cylinder components. Any debris which may catch in the slot opening 52 of channel beam 50 is pushed out of the way by legs 63 of the hooks 55 when the tailgate is once again lowered to the position shown in FIG. 2.

A final feature of the present invention which is not shown in the drawings but which is readily understandable to one skilled in the art is a hydraulic sequencing valve added to the hydraulic circuit to insure that the lowering function of cylinder 37 is completed before the latching function performed by extension of piston 73 of cylinder 68 is initiated. The same type of hydraulic sequencing valve accomplishes the reverse purpose of insuring that the unlatching function is completed before the lifting of the tailgate 23 takes place. The sequencing valves sense the hydraulic pressure of each of cylinders 37 and 68. Such pressure can be controlled to increase significantly when a cylinder reaches the end of its stroke as compared to when the cylinder is in the fully retracted position or when the cylinder is performing its function. The control valves for the hydraulic system, while preferably being combined in the manner indicated in this paragraph, can be separately controlled by manual control valves or by electrical or pneumatic control systems.

While the invention has been described in connection with a particular preferred embodiment, the invention is not to be taken as limited to such embodiment but is to be limited solely by the claims which follow. The particular number of hooks, slot openings and roller components has been found particularly suited for the type of machine illustrated in FIGS. 1–4, but a single hook and latching roller may be employed or a greater number of hooks and latching rollers may be chosen for some embodiments. Also, the particular method of moving rollers 84 into contact with the cam shaped suface 63 of hook plates 55 can be varied so that this function is performed with a mechanical lever rather than the hydraulic means shown. Similar modifications, all of which fall within the scope of the present invention, will be readily apparent to those skilled in the art after reading the foregoing specification and examining the drawings.

I claim:

1. A system for securing a closure to an opening comprising:

a container having an opening, a hinged closure means for sealing said opening, hook means secured to the periphery of said closure means including a cam-shaped surface on the free end thereof, said hook means being generally perpendicular to said closure means and extending along the outside of said container when said closure means seals said opening, roller means on said container for engaging said surface of said hook means, said roller means being movable from a first to a second position to urge said closure means into sealing engagement with said opening, and means for selectively causing engagement of said roller means with said surface to permit selective sealing of said opening.

2. The system as claimed in claim 1 wherein said means for selectively causing engagement comprises a crank shaft means including at least one crank link with an off-center shaft, said roller means being axially disposed on said off-center shaft.

3. The system as claimed in claim 2 further comprising hydraulic cylinder means coupled to said crank shaft means to permit axial rotation thereof.

4. The system as claimed in claim 3 further comprising compressible gasket means between said opening and the periphery of said closure means.

5. A sealing system for a body opening comprising:

a hollow material collection body including an opening for removal of material, a generally planar closure means for said opening, said closure means being mounted to said body by hinge means and means for causing said closure member to sealingly engage said body comprising:

i. hook means secured to the periphery of said closure member, said hook means incluidng an elongate portion disposed perpendicularly to said closure member and adjacent a side of said body and terminating in a hook protrusion oriented generally perpendicularly to said elongate portion and having a cam-like surface between the tip thereof and said elongate portion; and ii. means on said body for causing a roller to move from a first to a second position to selectively engage the tip of said hook protrusion and travel along said cam-like surface to the junction of said protrusion and elongate portion.

6. The invention set forth in claim 5 wherein said body includes a side adjacent to and perpendicular to said opening and wherein said closure member includes two parallel sides one of which is hinged to said body and the other of which is adjacent said side of said body.

7. The invention set forth in claim 6 including at least two of said hook means secured to said closure member adjacent said other side thereof.

8. The invention set forth in claim 7 wherein said roller engaging means comprises:

i. bearing block means located on said side of said body and intermediate said hook means, ii. a crank shaft supported for axial rotation within said bearing block means;

iii. a crank line on said shaft for each of said hook means, each of said crank links including an off-center shaft having a roller axially disposed thereon; and iv. means for causing axial rotation of said crank shaft to cause said rollers to travel from said first position out of engagement with said hook means to said second position in which said rollers engage the junction of said hook protrusion and the elongate portion of said hook means.

9. The invention of claim 8 wherein said axial rotation causing means comprises a lever means coupled to said crank shaft.

10. The invention of claim 9 including hydraulic cylinder coupled to said lever means for selectively rotating said crank shaft.

11. The invention set forth in claim 10 including additional hydraulic cylinder means for selectively moving said other side of said closure member away from said opening and hydraulic sequencing valve means for permitting activation of said sealing means only when said closure member is adjacent said opening and activation of said additional cylinder means only when said rollers are in said first position.

12. A system for latching and sealing the tailgate of a material collection body having an opening and a floor said tailgate being hingedly secured at its upper end to said body and having its lower end adjacent the rear of the floor of said body when said tailgate is in a closed position, said system comprising:

hook means secured to the lower edge of said tailgate and including an elongate portion which is substantially perpendicular to said tailgate and disposed below said floor of said body when said tailgate is in a closed position, said elongate portion terminating in a downwardly extending protrusion being substantially perpendicular to said elongate portion and having a camlike surface between the tip thereof and said elongate portion, roller means and means connected to said body to cause said roller means to selectively engage the tip of said hook protrusion and travel along said cam-like surface to the junction of said protrusion and elongate portion.

13. The invention of claim 12 wherein said body is a vacuum body and wherein gasket seal means are provided around the periphery of said tailgate.

14. The invention set forth in claim 12 wherein said roller engaging means comprises:

i. bearing block means located below the floor of said body and intermediate said hook means, ii. a crank shaft supported for axial rotation within said bearing block means;

iii. a crank link on said shaft for each of said hook means, each of said crank links including an off-center shaft having a roller axially disposed thereon; and iv. means for causing axial rotation of said crank shaft to cause said rollers to travel from a first position out of engagement with said hook means to a second position in which said rollers engage the junction of said hook protrusion and the elongate portion of said hook means.

15. The invention of claim 14 wherein said axial rotation causing means comprises a lever means coupled to said crank shaft.

16. The invention of claim 15 including hydraulic cylinder coupled to said lever means for selectively rotating said crank shaft.

17. The invention set forth in claim 16 including additional hydraulic cylinder means for selectively moving said other side of said closure member away from said opening and hydraulic sequencing valve means for permitting activation of said sealing means only when said closure member is adjacent said opening and activation of said additional cylinder means only when said rollers are in said first position.

* * * * *